US005884647A

United States Patent [19]

Dwek

[11] Patent Number: 5,884,647

[45] Date of Patent: Mar. 23, 1999

[54] FOLDING STRUCTURE

[76] Inventor: Abraham Dwek, 109 Phillips Ave., Deal, N.J. 07723

[21] Appl. No.: 915,536

[22] Filed: Aug. 15, 1997

[51] Int. Cl.[6] ..... E04H 15/48

[52] U.S. Cl. ..... 135/144; 135/147; 135/149; 135/153; 403/157

[58] Field of Search ..... 135/124, 136, 135/143, 144, 147, 148, 149, 151, 153, 909; 528/63, 222, 273, 274, 275, 126.1, 36.4; 403/87, 119, 157, 156, 150

[56] References Cited

U.S. PATENT DOCUMENTS

| | | | |
|---|---|---|---|
| 1,170,188 | 2/1916 | Rasmussen et al. | 135/149 |
| 1,806,312 | 5/1931 | Schiller . | |
| 2,077,620 | 4/1937 | Dicke . | |
| 2,151,908 | 3/1939 | Gottlieb | 135/136 |
| 2,168,913 | 8/1939 | Middleton . | |
| 3,762,748 | 10/1973 | Anders . | |
| 3,826,270 | 7/1974 | Hentges | 135/149 X |
| 4,066,089 | 1/1978 | Rainwater | 135/143 X |
| 4,077,418 | 3/1978 | Cohen | 135/143 X |
| 4,932,807 | 6/1990 | Rhodes . | |
| 5,049,104 | 9/1991 | Olsen . | |
| 5,167,246 | 12/1992 | Mortenson | 135/143 X |
| 5,595,203 | 1/1997 | Espinona | 135/124 |
| 5,638,853 | 6/1997 | Tsai | 135/151 X |
| 5,660,002 | 8/1997 | Lashinger | 135/124 X |

*Primary Examiner*—Lanna Mai
*Attorney, Agent, or Firm*—Michael I. Kroll

[57] ABSTRACT

A folding structure (16) has a plurality of elongated posts (18), with a plurality of tubular truss members (20). A plurality of connectors (22) are affixed to the elongated posts (18) vertically and the tubular truss members (20) horizontally together to form a fully assembled collapsible enclosure, that can be unfolded into a four sided framework to be utilized when needed and then can be folded up into a compact package to be stored when not in use.

2 Claims, 21 Drawing Sheets

FOLDING STRUCTURE

BACKGROUND OF THE INVENTION

1. Field of the Invention

The instant invention relates generally to canopy supports and more specifically it relates to a folding structure. The folding structure is a collapsible fully assembled framework that can be unfolded into an enclosure when needed and then folded up into a compact size for storage.

2. Description of the Prior Art

Numerous canopy supports have been provided in prior art. For example, U.S. Pat. No. 4,607,656 to Carter is illustrative of such prior art. This patent shows a quick-erect collapsible shelter having four or more telescoping legs. The present invention uses pivoting members for collapsing the structure and not telescoping members. While this unit may be suitable for the particular purpose to which it addresses, it would not be as suitable for the purposes of the present invention as heretofore described.

SUMMARY OF THE INVENTION

A primary object of the present invention is to provide a folding structure that will overcome the shortcomings of the prior art devices.

Another object is to provide a folding structure that is a collapsible, fully assembled framework, which can be unfolded into an enclosure to be utilized when needed and then be folded up into a compact size for storage.

An additional object is to provide a folding structure that can be used as a Sukkah which is an enclosure Jews erect for observance of the holiday of Succoth, as well as a tent, a temporary work enclosure, a scaffolding and a merchandise display unit.

A further object is to provide a folding structure that is simple and easy to use.

A still further object is to provide a folding structure that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein.

Similar reference characters denote corresponding features consistently throughout the attached drawings.

DETAILED DESCRIPTION OF THE PREFERRED EMBODIMENTS

Figure 1:
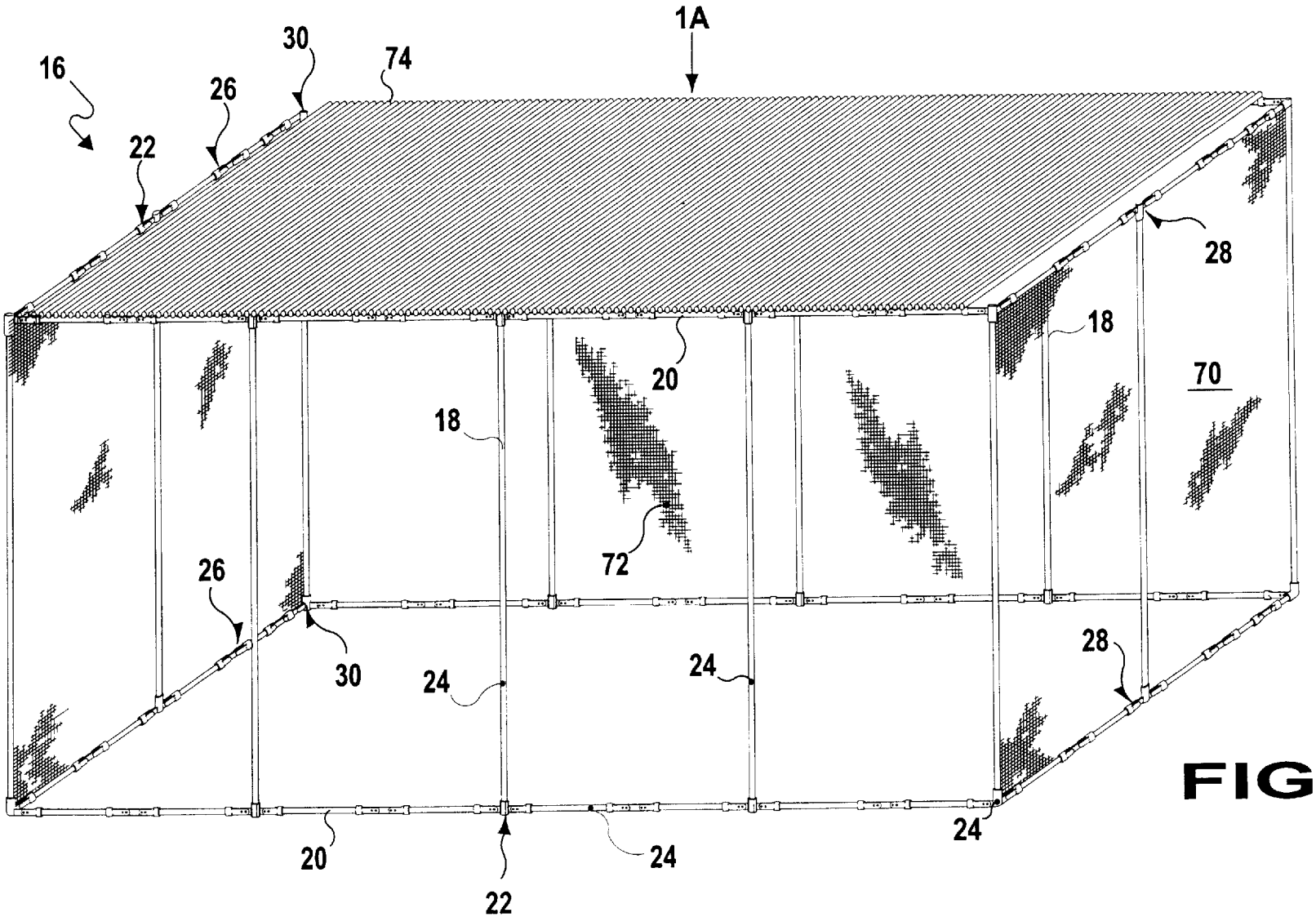
FIG. 1 is a front perspective view of a first embodiment of the instant invention in an unfolded position.
Figure 1A:
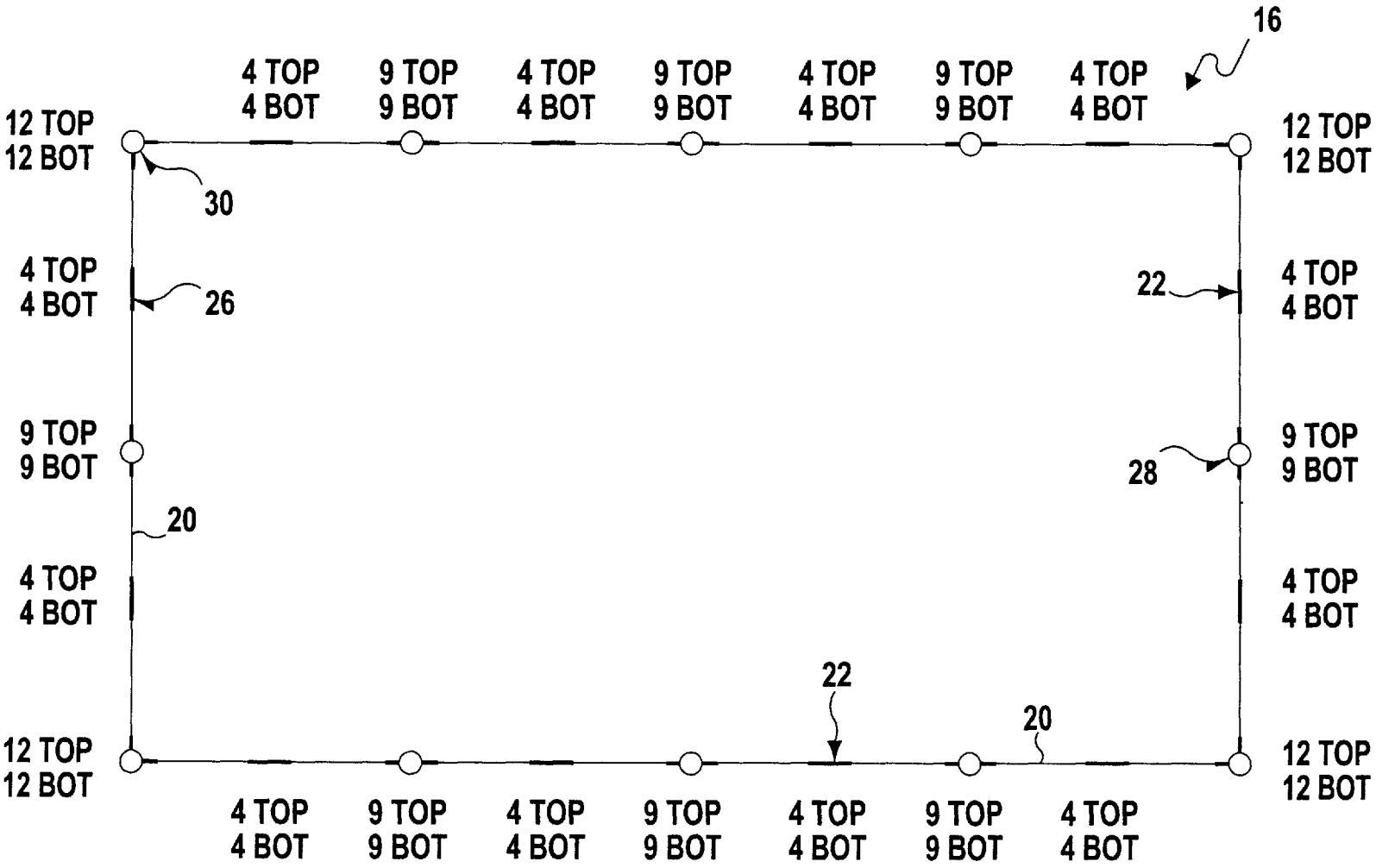
FIG. 1A is a diagrammatic top view of the first embodiment in the unfolded position taken in the direction of arrow 1A in FIG. 1.

Turning now descriptively to the drawings, in which similar reference characters denote similar elements throughout the several views, FIGS. 1 through 14E illustrate a folding structure 16 of the present invention. With regard to the reference numerals used, the following numbering is used throughout the various drawing figures.

16 folding structure
18 elongated post of 16
20 tubular truss member of 16
22 connector of 16
24 lightweight, strong durable material for 18, 20 and 22
26 #4 slip on rail fitting for 22
28 #9 slip on rail fitting for 22
30 #12 slip on rail fitting for 22
32 swivel bar of 26
34 socket of 26, 28, 30, 46, 48, 52, 60, 62, 64 and 66
36 forked end on 34
38 pivot pin of 26, 28, 30, 46, 48, 52, 60, 62, 64 and 66
40 thumbscrew of 26, 28, 30, 46, 48, 52, 60, 62, 64 and 66
42 sleeve of 28, 30, 46, 48, 60, 62, 64 and 66
44 vertical arm of 28, 30, 60, 62, 64 and 66
46 #2 slip on rail fitting for 22
48 #3 slip on rail fitting for 22
50 #5 slip on rail fitting for 22
52 #6 slip on rail fitting for 22
54 horizontal arm of 46, 48, 60 and 62
56 T-shaped sleeve for 50
58 tongue on 34
60 #7 slip on rail fitting for 22
62 #8 slip on rail fitting for 22
64 #10 slip on rail fitting for 22
66 #11 slip on rail fitting for 22
68 horizontal elongated arm of 64 and 66

70 wall panel on 16

72 woven nylon thread fabric of 70

74 bamboo screen mat on 16

The folding structure 16 comprises a plurality of elongated posts 18, with a plurality of tubular truss members 20. A plurality of connectors 22 are affixed to the elongated post 18 vertically and the tubular truss members 20 horizontally together to form a fully assembled collapsible enclosure, that can be unfolded into a four sided framework to be utilized when needed and then can be folded up into a compact package to be stored when not in use. The elongated posts 18, the tubular truss members 20 and the connectors 22 are all fabricated out of a lightweight, strong durable material 24, such as aluminum, plastic or wood.

Figure 1B:
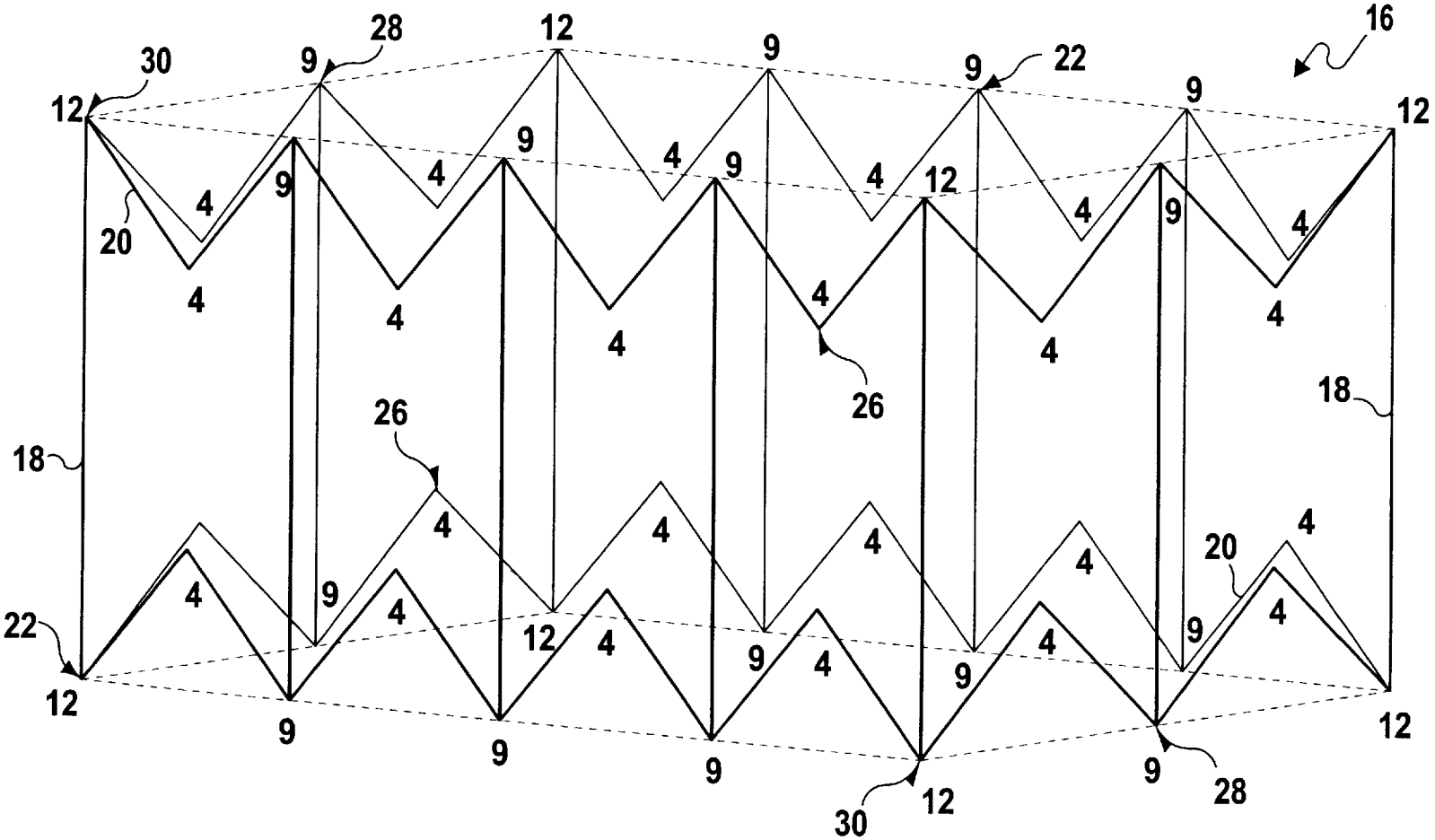
FIG. 1B is a diagrammatic front perspective view of the first embodiment in a partly folded position.

The folding structure 16, as shown in FIGS. 1 through 1B, is a first embodiment wherein the connectors 22 include a plurality of #4 slip on rail fittings 26. Each #4 slip on rail fitting 26 will secure two of the tubular truss members 20 together. A plurality of #9 slip on rail fittings 28 are provided. Each #9 slip on rail fitting 28 will secure two of the tubular truss members 20 and one elongated post 18 together. A plurality of #12 slip on rail fittings 30 are also provided. Each #12 slip on rail fitting 30 will secure two of the tubular truss members 20 and one elongated post 18 together at a corner.

Figure 4:
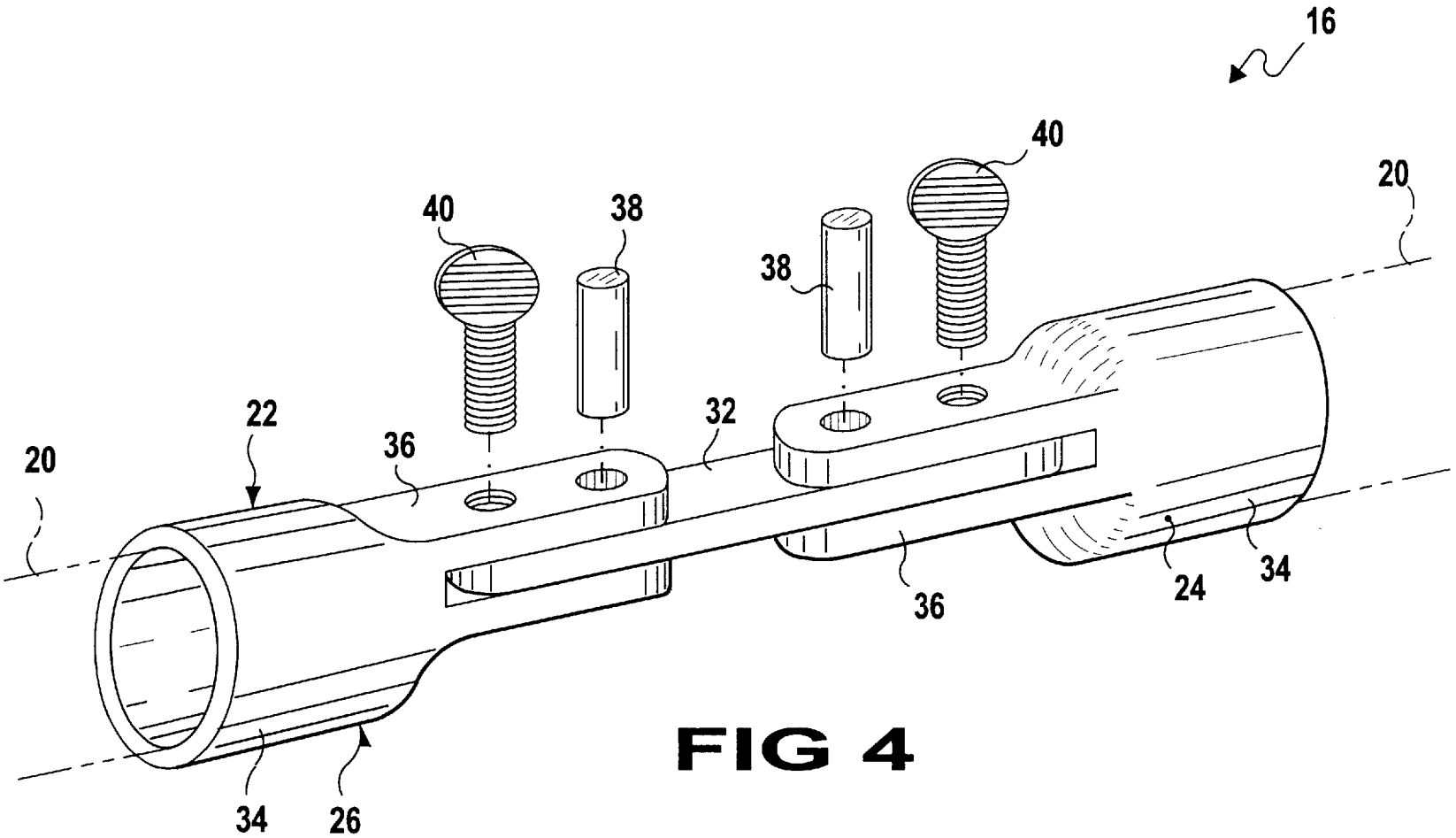

Each #4 slip on rail fitting 26, as best seen in FIG. 4, consists of a swivel bar 32. A pair of sockets 34 receive opposite ends of two tubular truss members 20. The sockets 34 each have a forked end 36 that fits over one end of the swivel bar 32. A pair of pivot pins 38 are provided. Each pivot pin 38 extends transversely through one forked end 36 and the swivel bar 32, to allow the sockets 34 to pivot. A pair of thumbscrews 40 are also provided. Each thumbscrew 40 threads transversely through one forked end 36 and the swivel bar 32, to lock the sockets 34 in place.

Figure 9:
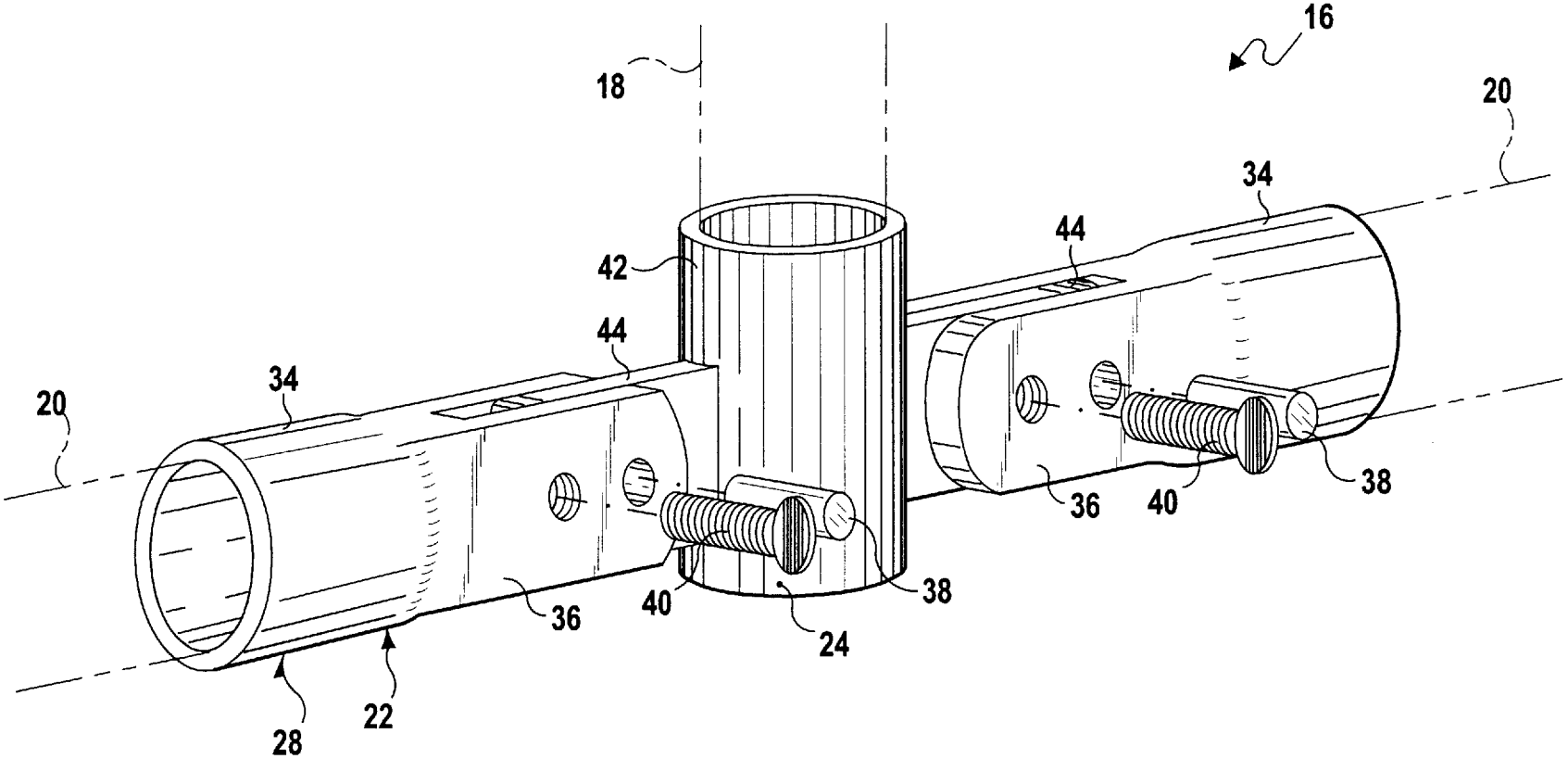

Each #9 slip on rail fitting 28, as best seen in FIG. 9, includes a sleeve 42 to receive one end of the elongated post 18. A pair of vertical arms 44 extend at a one hundred and eighty degree angle from the sleeve 42. A pair of sockets 34 receive opposite ends of the two tubular truss members 20. The sockets 34 each have a forked end 36 that fits over one of the vertical arms 44. A pair of pivot pins 38 are provided. Each pivot pin 38 extends transversely through one forked end 36 and one vertical arm 44, to allow the sockets 34 to pivot. A pair of thumbscrews 40 are also provided. Each thumbscrew 40 threads transversely through one forked end 36 and one vertical arm 44, to lock the sockets 34 in place.

Figure 12:
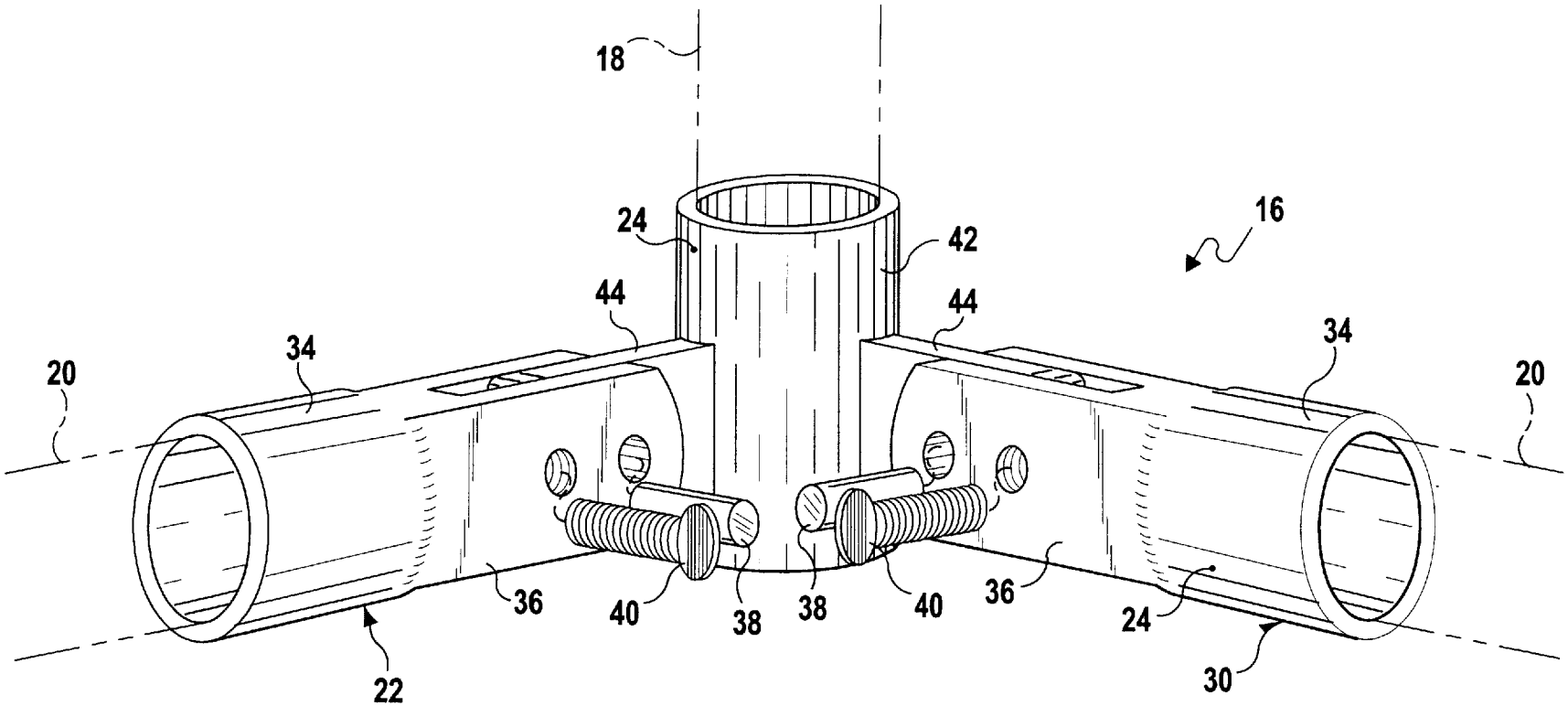

Each #12 slip on rail fitting 30, as best seen in FIG. 12, contains a sleeve 42 to receive one end of the elongated post 18. A pair of vertical arms 44 extend at a ninety degree angle from the sleeve 42. A pair of sockets 34 receive opposite ends of the two tubular truss members 20. The sockets 34 each have a forked end 36 that fits over one of the vertical arms 44. A pair of pivot pins 38 are provided. Each pivot pin 38 extends transversely through one forked end 36 and one vertical arm 44, to allow the sockets 34 to pivot. A pair of thumbscrews 40 are also provided. Each thumbscrew 40 threads transversely through one forked end 36 and one vertical arm 44, to lock the sockets 34 in place.

Figure 13:
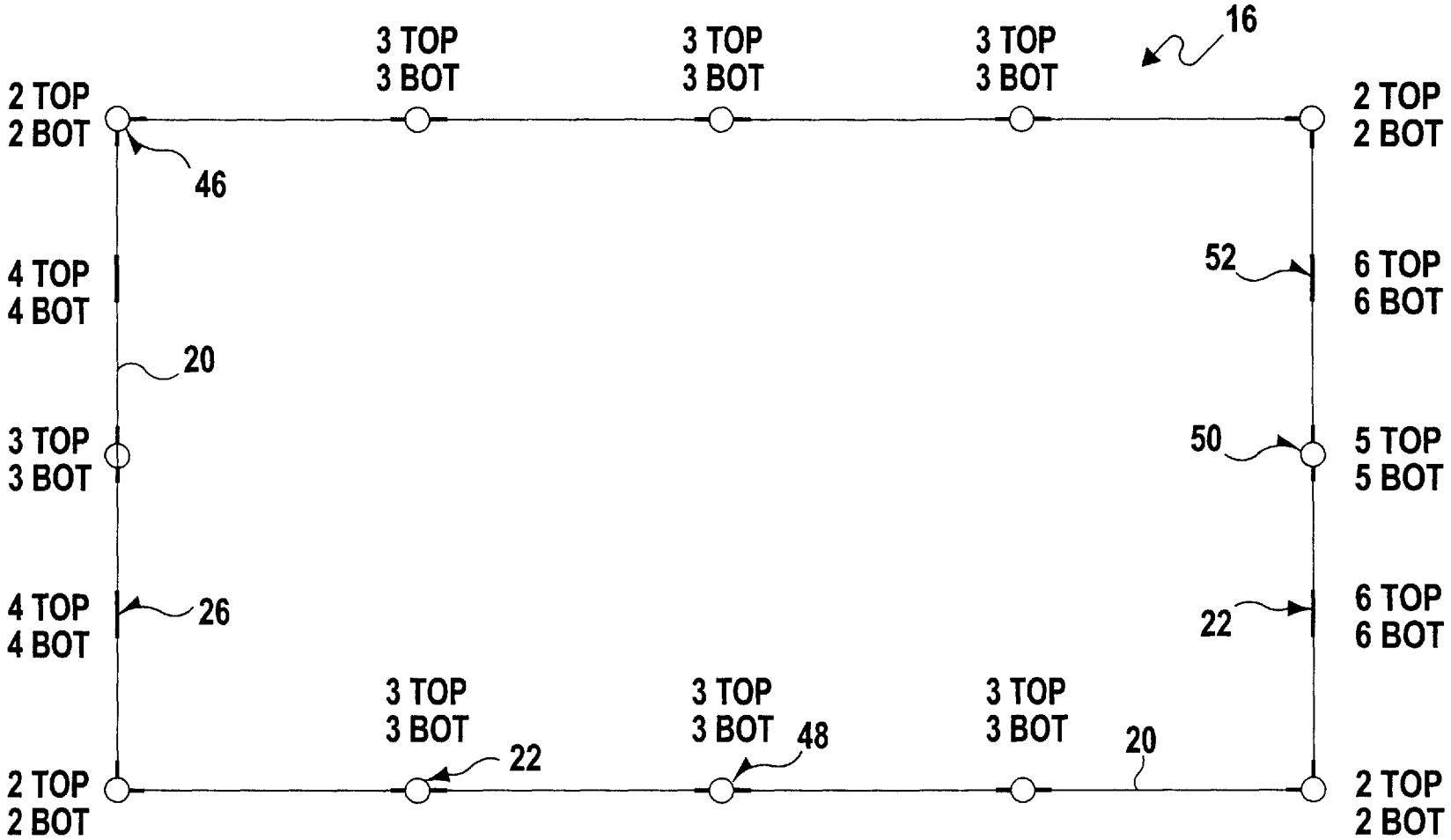
FIG. 13 is a diagrammatic top view of a second embodiment of the instant invention in an unfolded position.
Figure 13A:
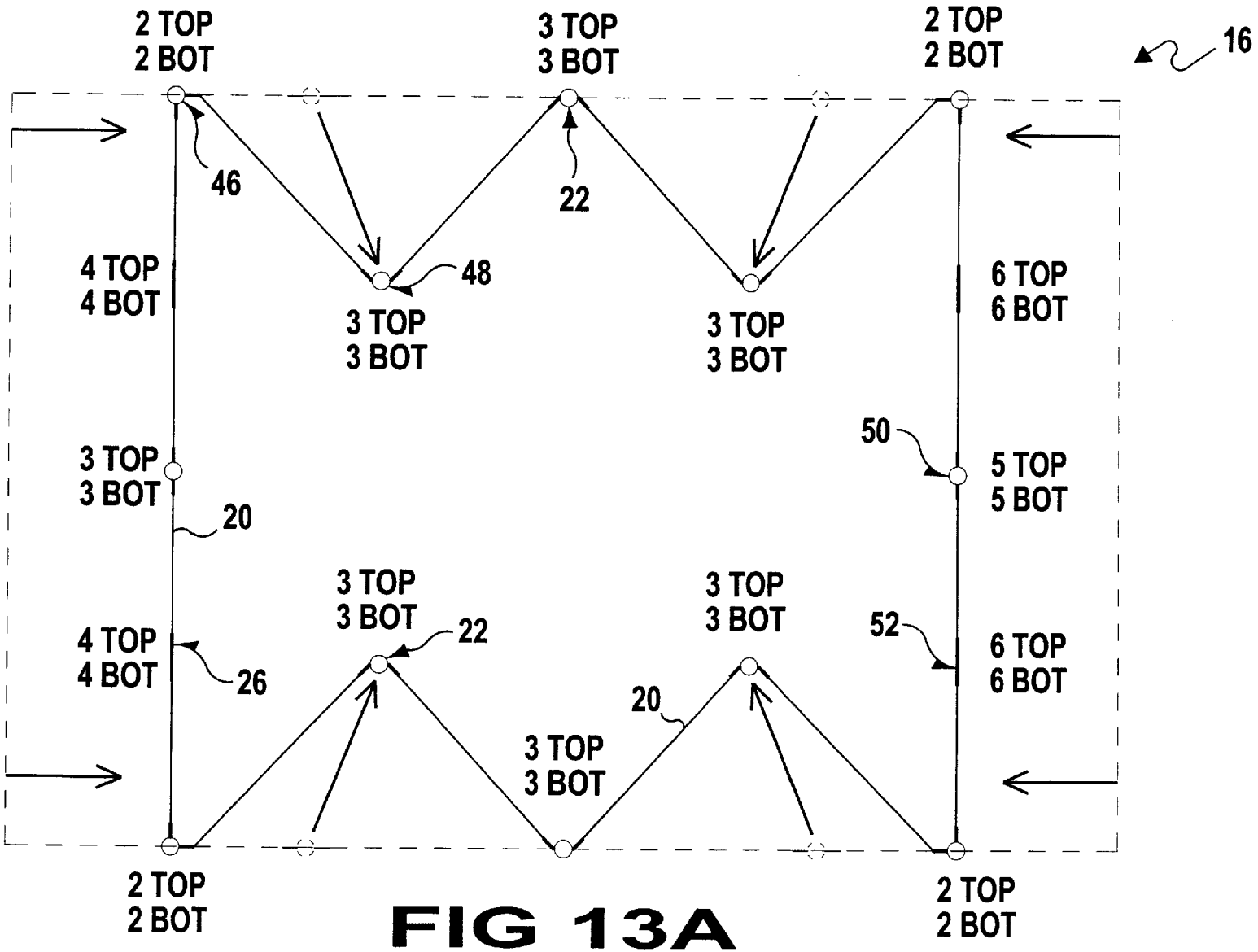
FIG. 13A is a diagrammatic top view of the second embodiment going into an intermediate folded position.
Figure 13C:
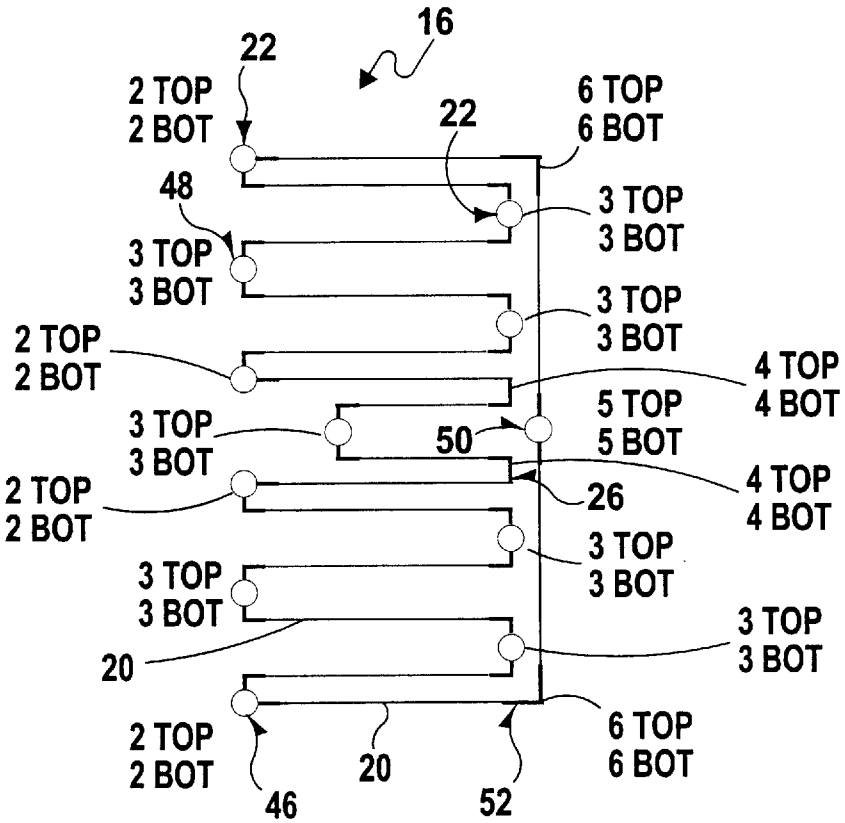
FIG. 13C is a diagrammatic top view of the second embodiment in a final folded position.
Figure 13B:
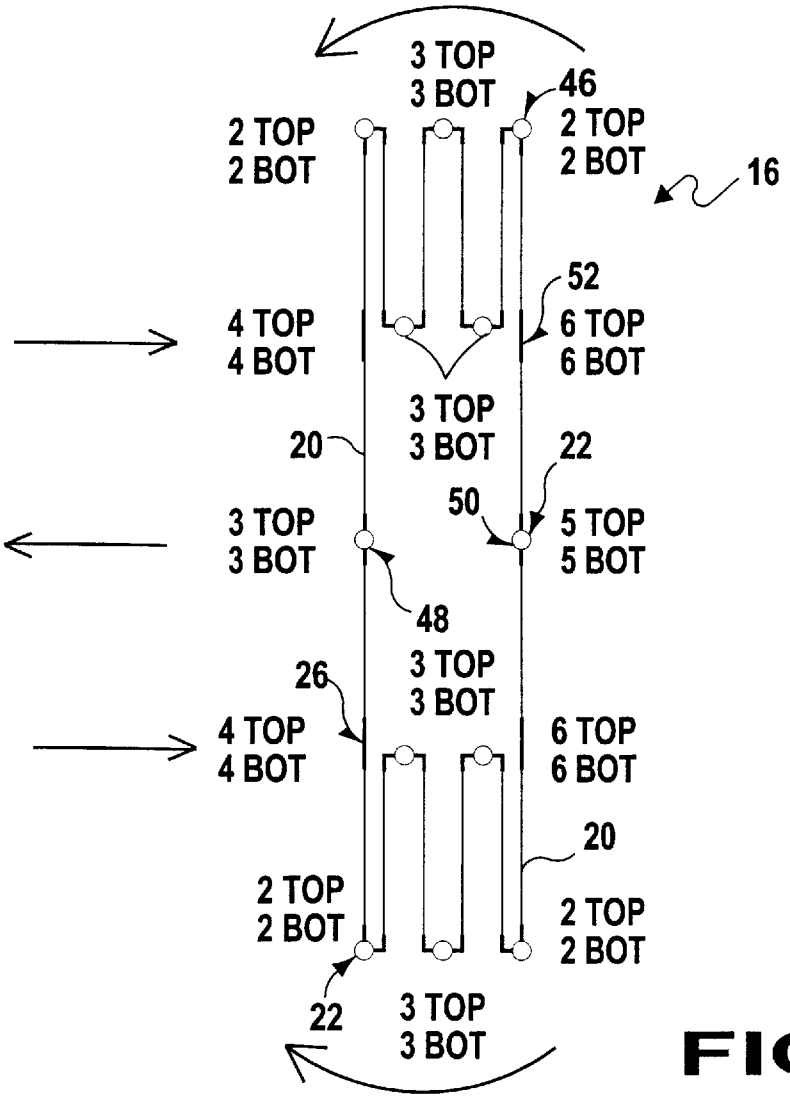
FIG. 13B is a diagrammatic top view of the second embodiment in the intermediate folded position.

The folding structure 16, as best seen in FIG. 13 through 13C, is a second embodiment wherein the connectors 22 include a plurality of #2 slip on rail fittings 46. Each #2 slip on rail fitting 46 will secure two of the tubular truss members 20 and one elongated post 18 together at a corner. A plurality of #3 slip on rail fittings 48 are provided. Each #3 slip on rail fitting 48 will secure two of the tubular truss members 20 and one elongated post 18 together. A plurality of #4 slip on rail fitting 26 are provided. Each #4 slip on rail fitting 26 will secure two of the tubular truss members 20 together. A plurality of #5 slip on rail fittings 50 are provided. Each #5 slip on rail fitting 50 will secure two of the tubular truss members 20 and one elongated post 18 together. A plurality of #6 slip on rail fittings 52 are also provided. Each #6 slip on rail fitting 52 will secure two of the tubular truss members 20 together.

Figure 2:
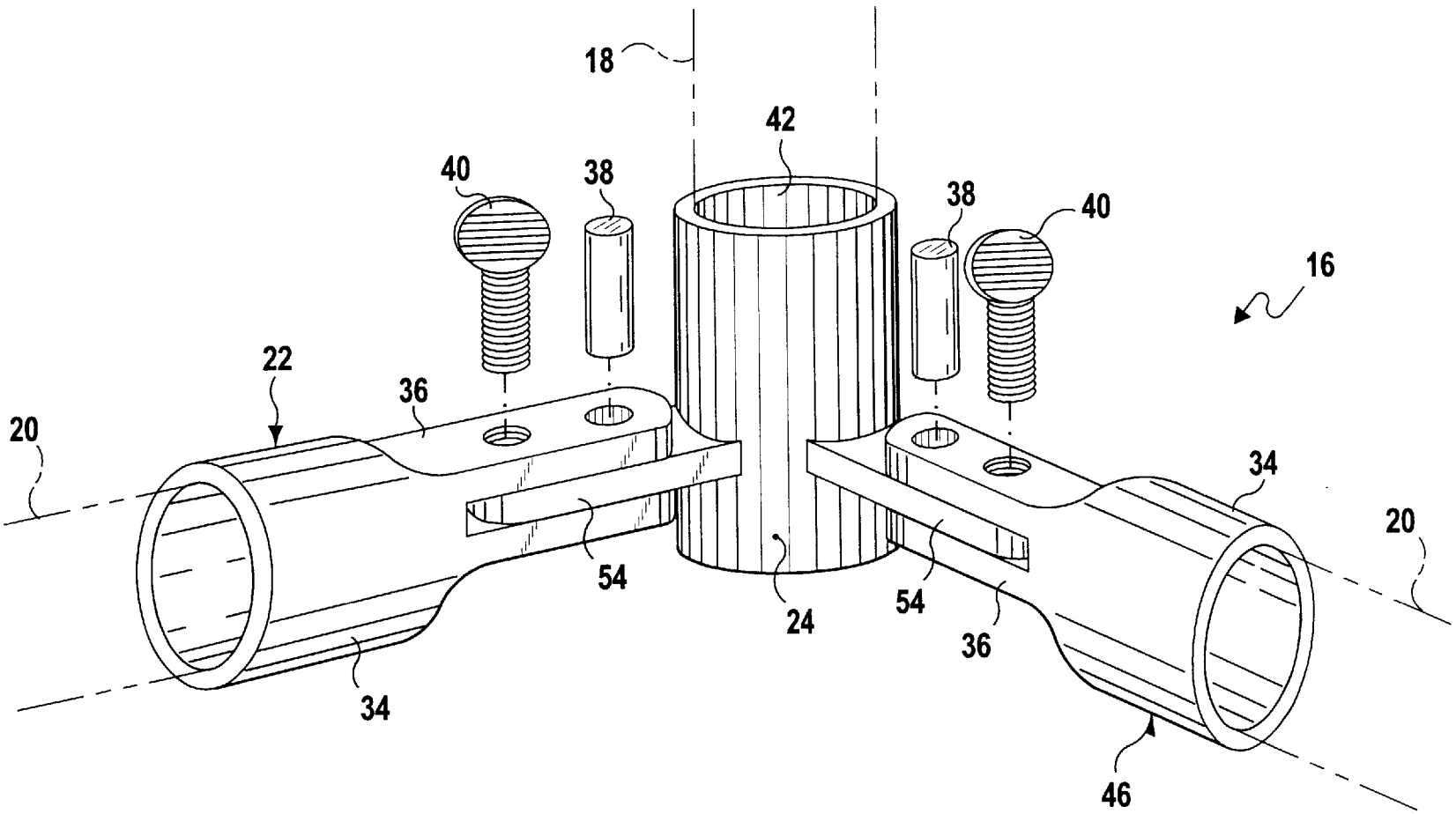
FIGS. 2 through 12 are perspective views of the various fittings used in all of the embodiments of the instant invention.

Each #2 slip on rail fitting 46, as best seen in FIG. 2, consists of a sleeve 42 to receive one end of the elongated post 18. A pair of horizontal arms 54 extend at a ninety degree angle from the sleeve 42. A pair of sockets 34 receive opposite ends of two tubular truss members 20. The sockets 34 each have a forked end 36 that fits over one of the horizontal arms 54. A pair of pivot pins 38 are provided. Each pivot pin 38 extends transversely through one forked end 36 and one horizontal arm 54, to allow the sockets 34 to pivot. A pair of thumbscrews 40 are also provided. Each thumbscrew 40 threads transversely through one forked end 36 and one horizontal arm 54, to lock the sockets 34 in place.

Figure 3:
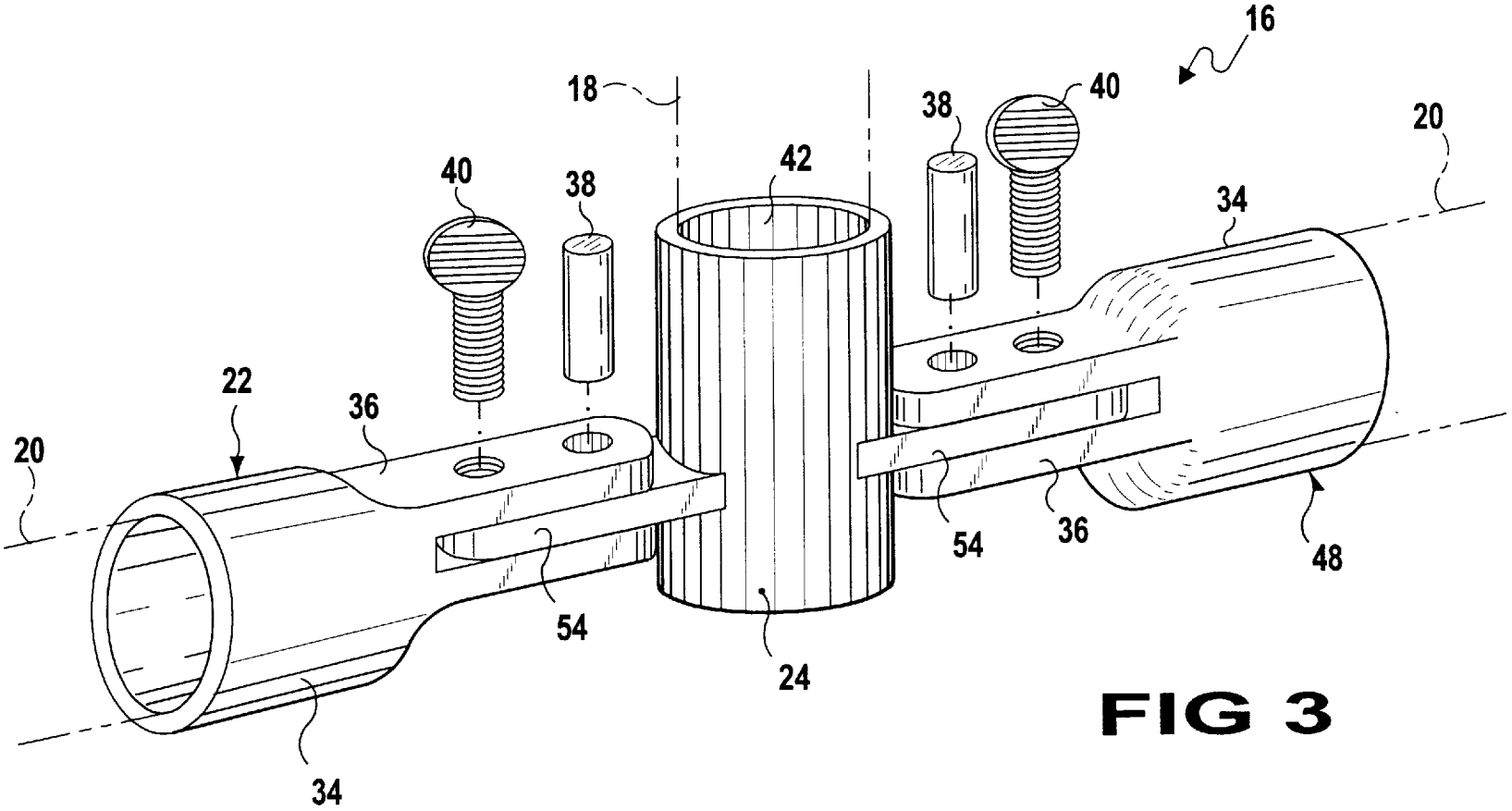

Each #3 slip on rail fitting 48, as best seen in FIG. 3, includes a sleeve 42 to receive one end of the elongated post 18. A pair of horizontal arms 54 extend at a one hundred and eighty degree angle from the sleeve 42. A pair of sockets 34 receive opposite ends of two tubular truss members 20. The sockets 34 each have a forked end 36 that fits over one of the horizontal arms 54. A pair of pivot pins 38 are provided. Each pivot pin 38 extends transversely through one forked end 36 and one horizontal arm 54, to allow the sockets 34 to pivot. A pair of thumbscrews 40 are also provided. Each thumbscrew 40 threads transversely through one forked end 36 and one horizontal arm 54, to lock the sockets 34 in place.

Figure 5:
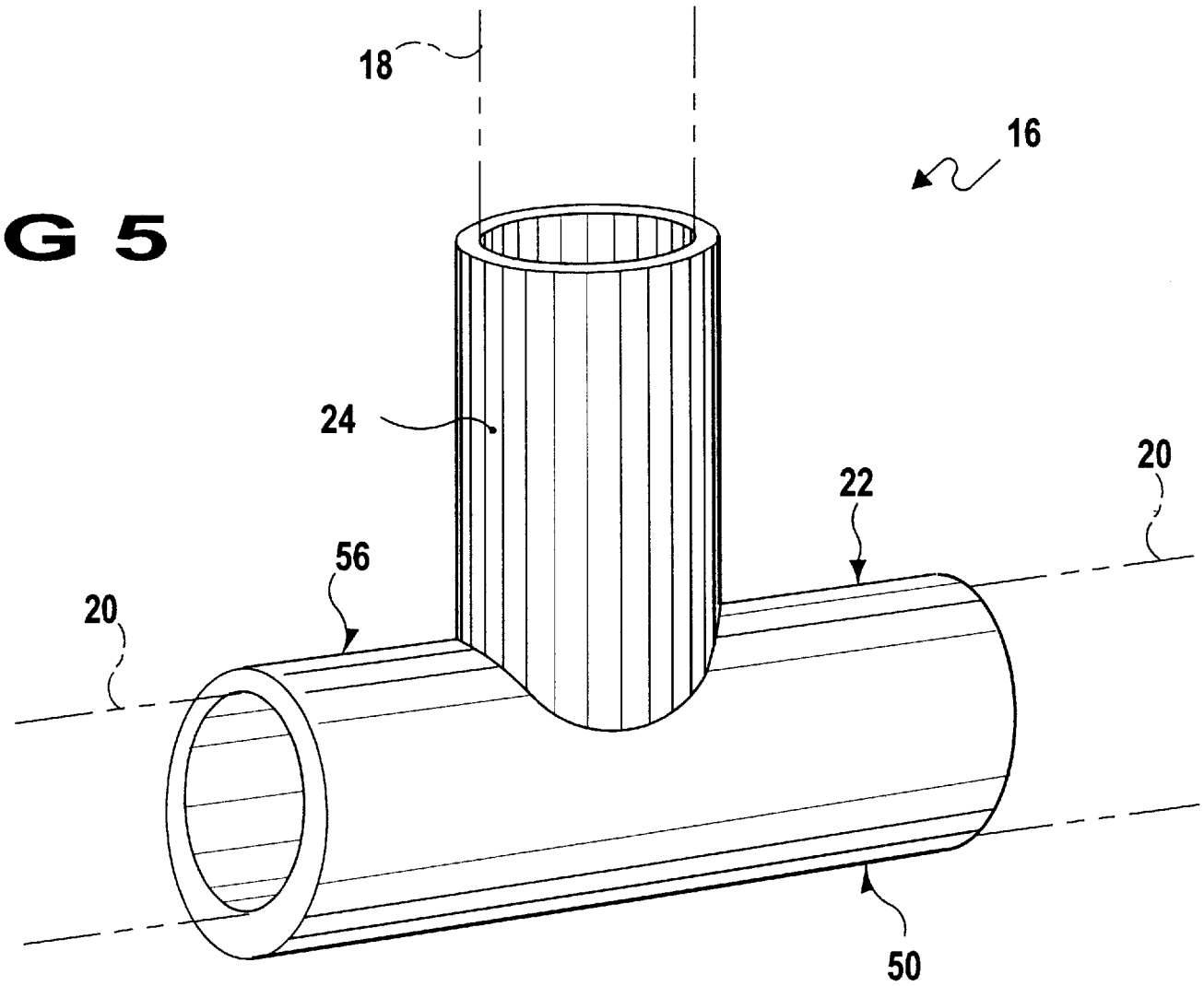
Figure 6:
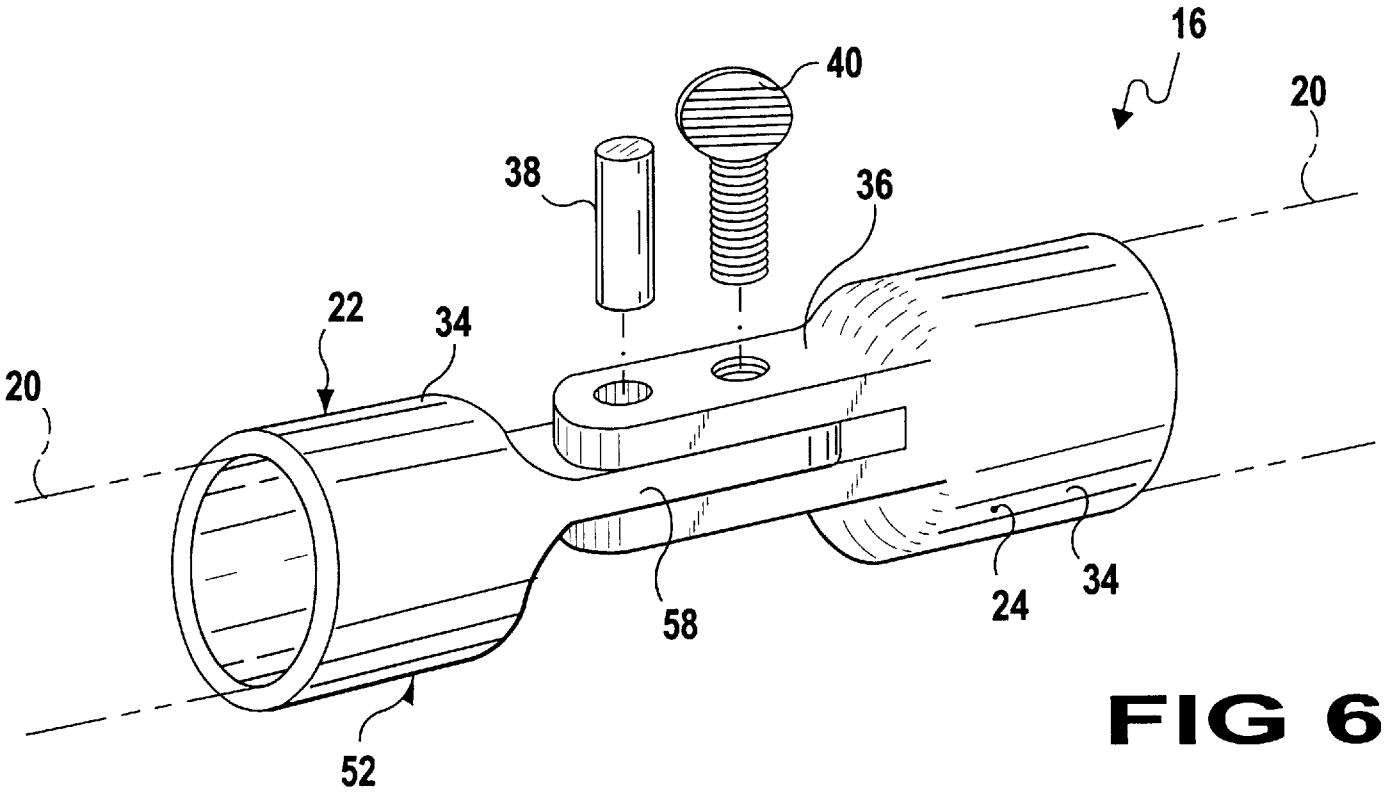

Each #4 slip on rail fitting 26 in the second embodiment is identical in construction with each one in the first embodiment described above. Each #5 slip on rail fitting 50, as best seen in FIG. 5, is a T-shaped sleeve 56 to receive one end of the elongated post 18 and opposite ends of the two tubular truss members 20 together. Each #6 slip on rail fitting 52, as best seen in FIG. 6, contains a first socket 34 to receive an end of one tubular truss member 20. The first socket 34 has a tongue 58 extending therefrom. A second socket 34 receives an end of another tubular truss member 20. The second socket 34 has a forked end 36 that fits over the tongue 58 on the first socket 34. A pivot pin 38 extends transversely through the forked end 36 and the tongue 58, to allow the sockets 34 to pivot. A thumbscrew 40 threads transversely through the forked end 36 and the tongue 58, to lock the sockets 34 in place.

Figure 14:
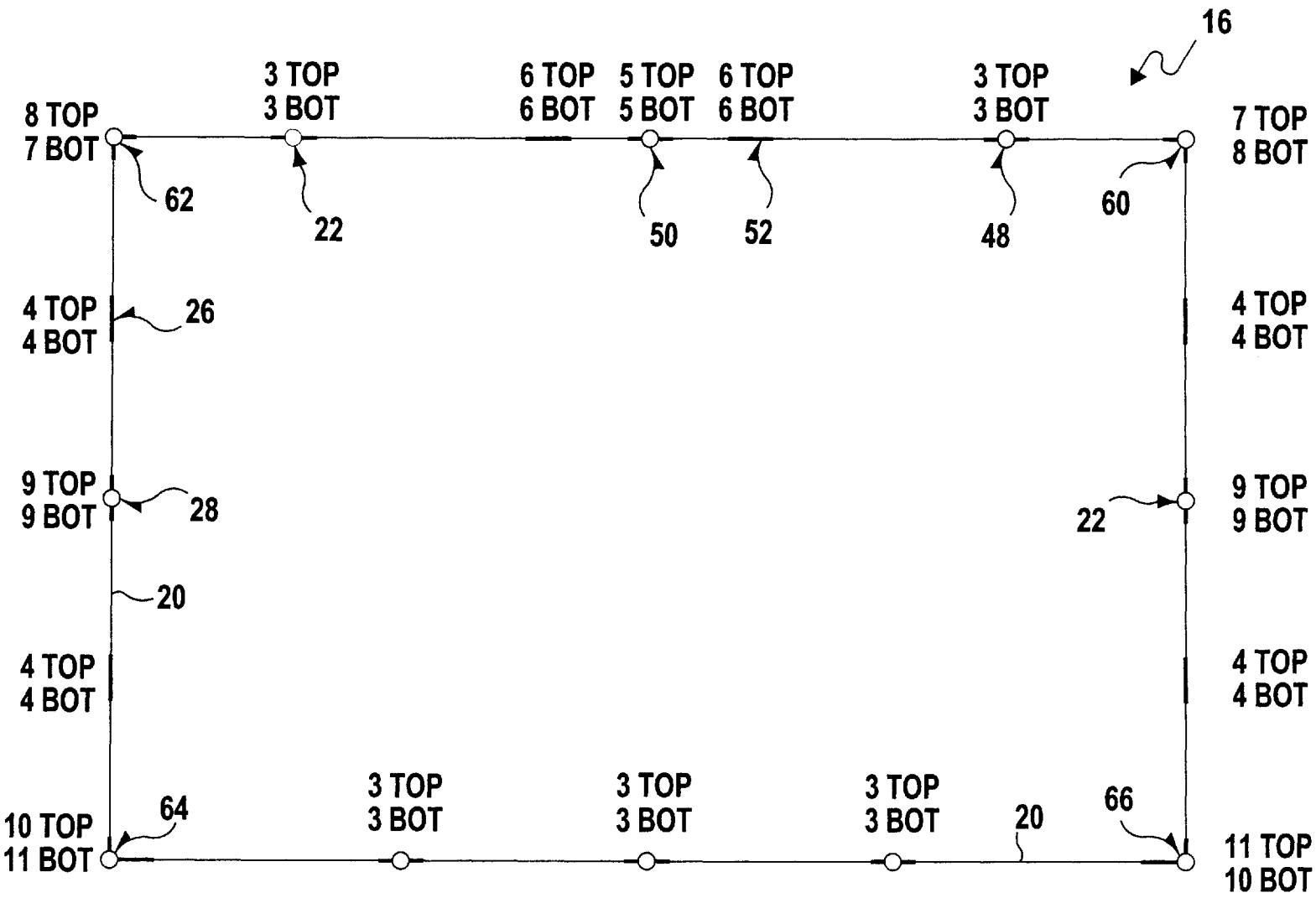
FIG. 14 is a diagrammatic top view of a third embodiment of the instant invention in an unfolded position.
Figure 14A:
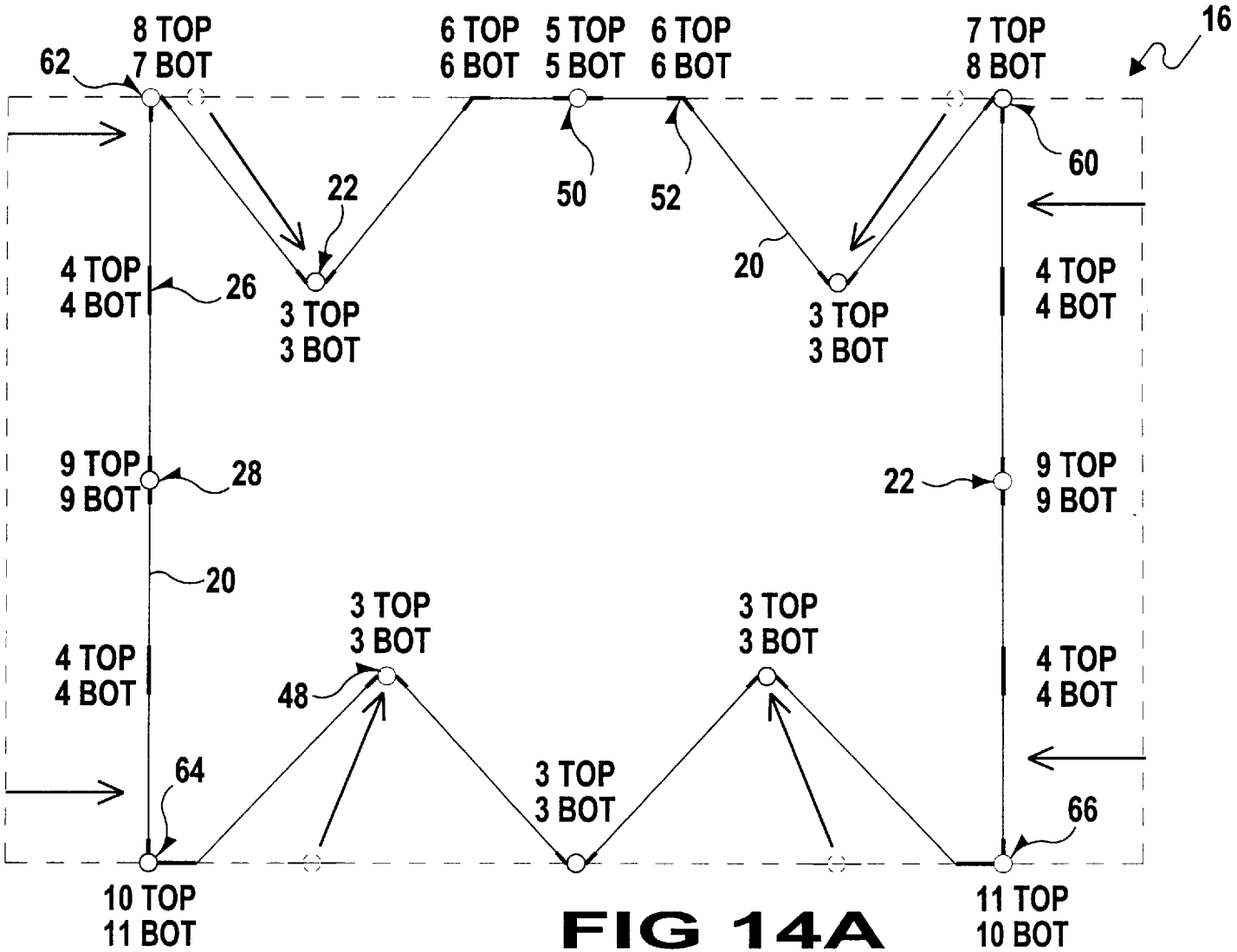
FIG. 14A is a diagrammatic top view of the third embodiment going into an intermediate folded position.
Figure 14B:
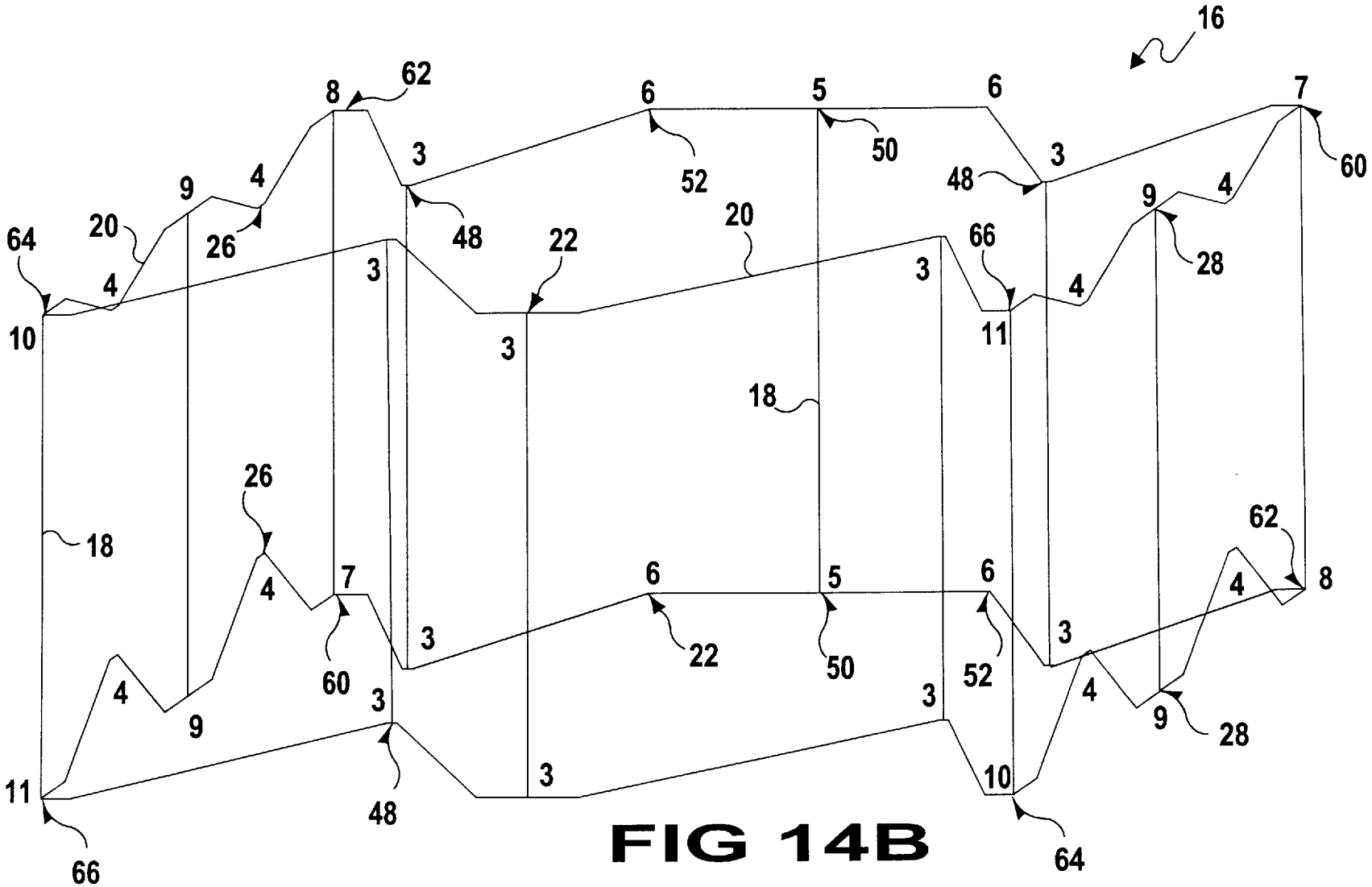
FIG. 14B is a diagrammatic front perspective view of the third embodiment going into the intermediate folded position.
Figure 14D:
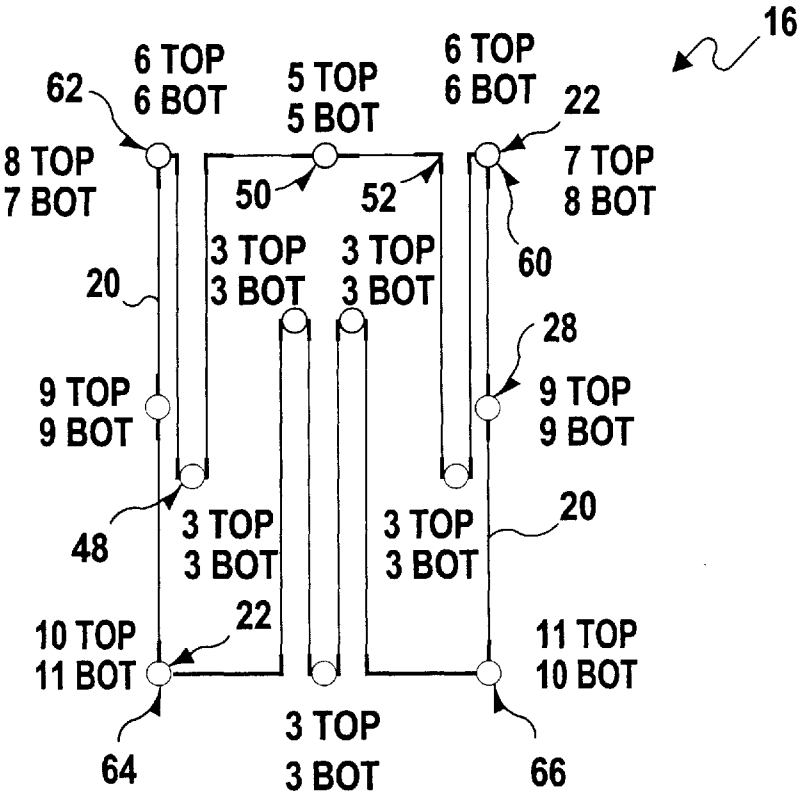
FIG. 14D is a diagrammatic top view of the third embodiment in a final folded position.
Figure 14C:
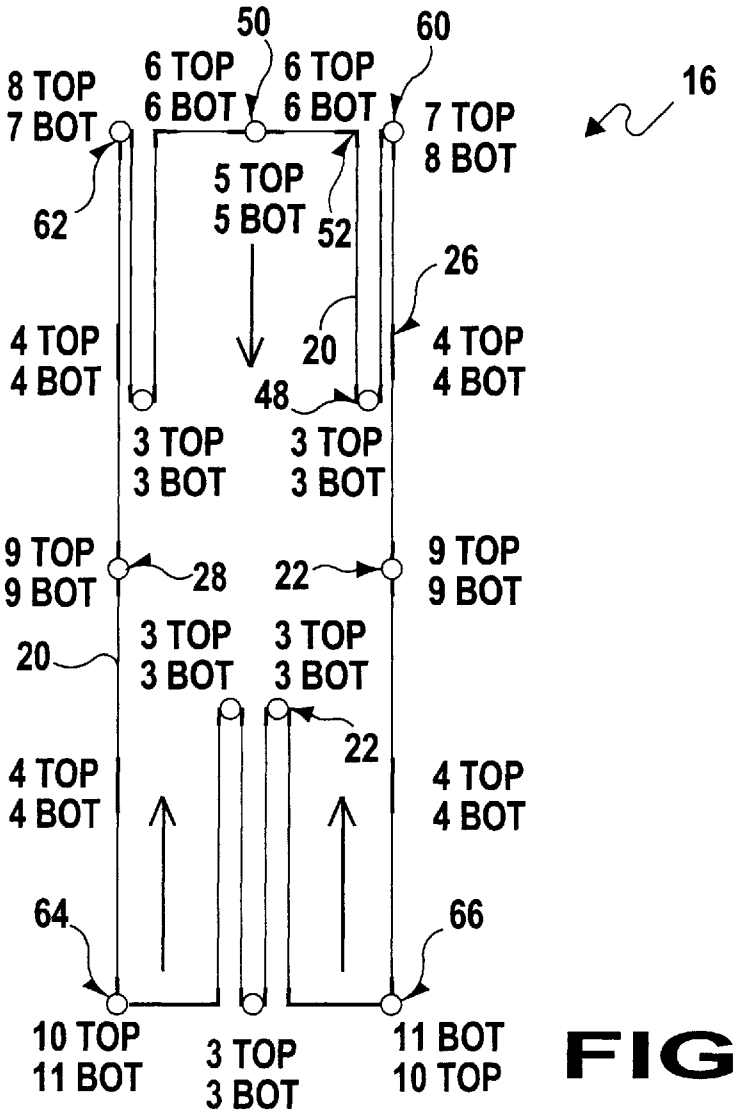
FIG. 14C is a diagrammatic top view of the third embodiment in the intermediate folded position.

The folding structure 16, as shown in FIGS. 14 through 14D, is a third embodiment wherein the connectors 22 include a plurality of #3 slip on rail fittings 48. Each #3 slip on rail fitting 48 will secure two of the tubular truss members 20 and one elongated post 18 together. A plurality of #4 slip on rail fittings 26 are provided. Each #4 slip on rail fitting 26 will secure two of the tubular truss members 20 together. A plurality of #5 slip on rail fittings 50 are provided. Each #5 slip on rail fitting 50 will secure two of the tubular truss members 20 and one elongated post 18 together. A plurality of #6 slip on rail fittings 52 are provided. Each #6 slip on rail fitting 52 will secure two of the tubular truss members 20 together.

A plurality of #7 slip on rail fittings 60 are provided. Each #7 slip on rail fitting 60 will secure two of the tubular truss members 20 and one elongated post 18 together at a corner. A plurality of #8 slip on rail fittings 62 are provided. Each #8 slip on rail fitting 62 will secure two of the tubular truss members 20 and one elongated post 18 together at a corner.

A plurality of #9 slip on rail fittings 28 are provided. Each #9 slip on rail fitting 28 will secure two of the tubular truss members 20 and one elongated post 18 together. A plurality of #10 slip on rail fittings 64 are provided. Each #10 slip on rail fitting 64 will secure two of the tubular truss members 20 and one elongated post 18 together at a corner. A plurality of #11 slip on rail fittings 66 are also provided. Each #11 slip on rail fitting 66 will secure two of the tubular truss members 20 and one elongated post 18 together at a corner.

Each #3 slip on rail fitting 48, #4 slip on rail fitting 26, #5 slip on rail fitting 50 and #6 slip on rail fitting 52 in the third embodiment is identical in construction with each one in the second embodiment described above.

Figure 7:
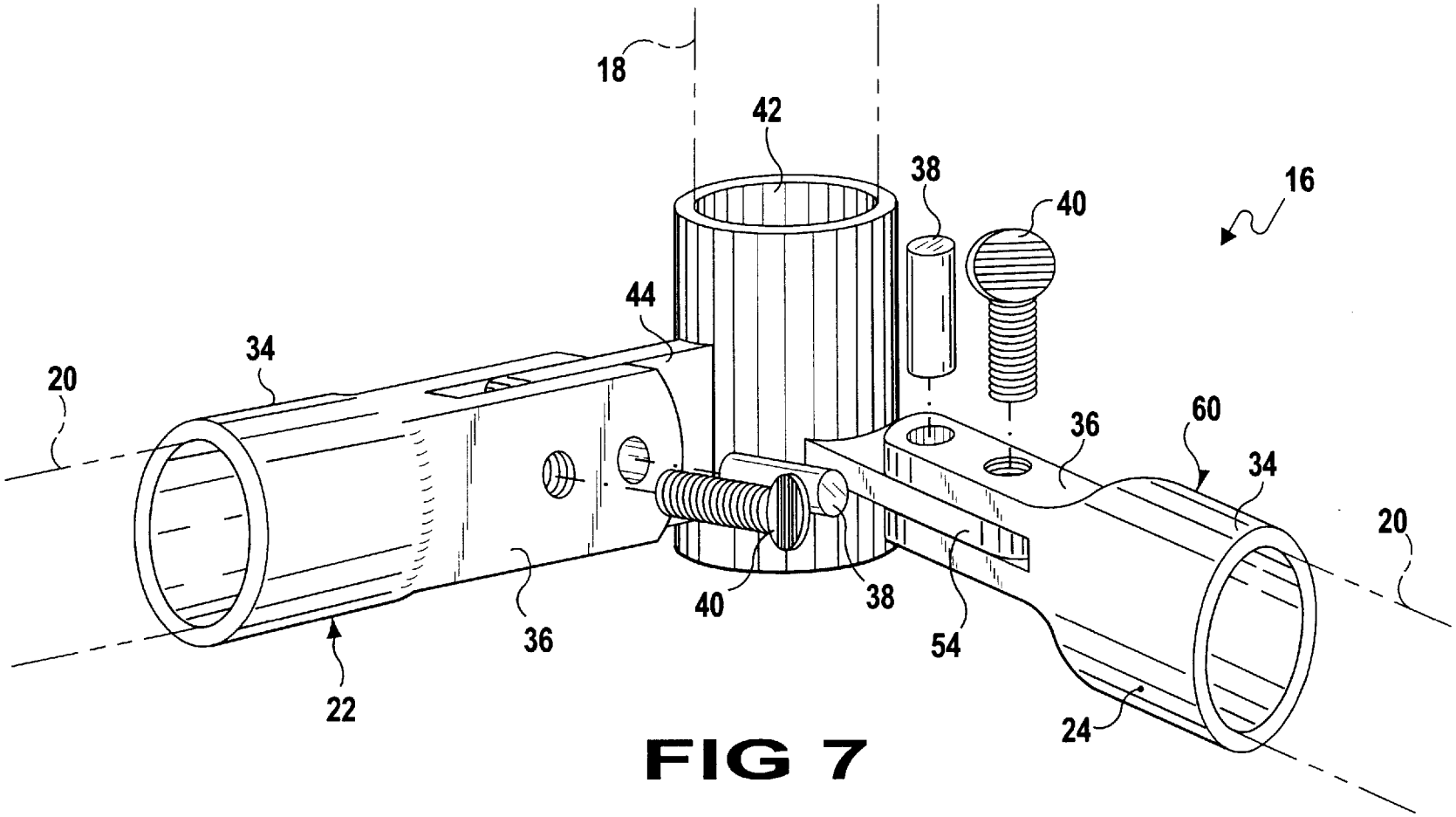

Each #7 slip on rail fitting 60, as best seen in FIG. 7, includes a sleeve 42 to receive one end of the elongated post 18. A vertical arm 44 extends from a left side of the sleeve 42. A horizontal arm 54 extends at a ninety degree angle from a right side of the sleeve 42. A pair of sockets 34 receive opposite ends of the two tubular truss members 20. The sockets 34 each have a forked end 36. The first forked end 36 fits over the vertical arm 44, while the second forked end 36 fits over the horizontal arm 54. A pair of pivot pins 38 are provided. The first pivot pin 38 extends transversely through the first forked end 36 and the vertical arm 44, to allow the first socket 34 to pivot. The second pivot pin 38 extends transversely through the second forked end 36 and the horizontal arm 54, to allow the second socket 34 to pivot. A pair of thumbscrews 40 are also provided. The first thumbscrew 40 threads transversely through the first forked end 36 and the vertical arm 44, to lock the first socket 34 in place. The second thumbscrew 40 threads transversely through the second forked end 36 and the horizontal arm 54, to lock the second socket 34 in place.

Figure 8:
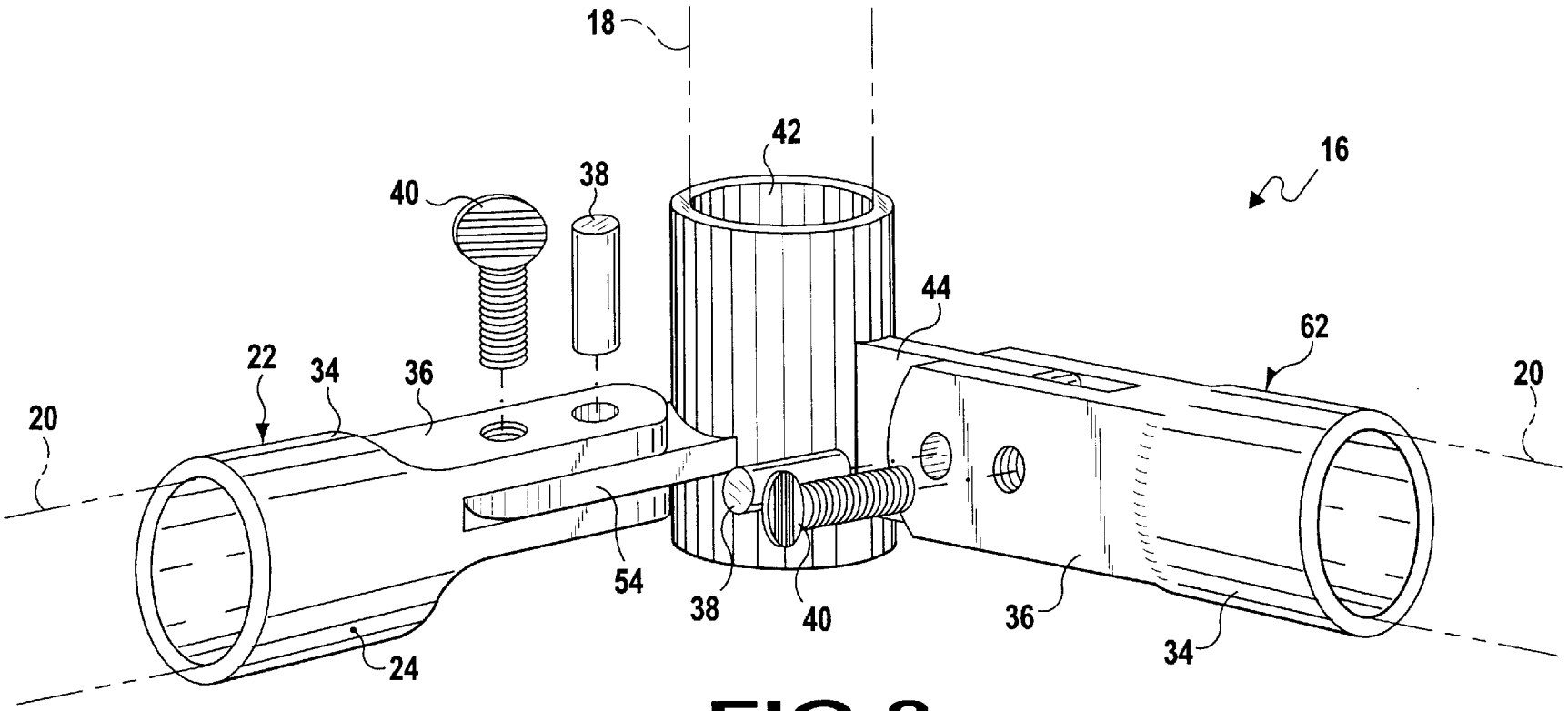

Each #8 slip on rail fitting 62, as best seen in FIG. 8, contains a sleeve 42 to receive one end of the elongated post 18. A horizontal arm 54 extends from a left side of the sleeve 42. A vertical arm 44 extends at a ninety degree angle from a right side of the sleeve 42. A pair of sockets 34 receive opposite ends of the two tubular truss members 20. The sockets 34 each have a forked end 36. The first forked end 36 fits over the horizontal arm 54, while the second forked end 36 fits over the vertical arm 44. A pair of pivot pins 38 are provided. The first pivot pin 38 extends transversely through the first forked end 36 and the horizontal arm 54, to allow the first socket 34 to pivot. The second pivot pin 38 extends transversely through the second forked end 36 and the vertical arm 44, to allow the second socket 34 to pivot. A pair of thumbscrews 40 are also provided. The first thumbscrew 40 threads transversely through the first forked end 36 and the horizontal arm 54, to lock the first socket 34 in place. The second thumbscrew 40 threads transversely through the second forked end 36 and the vertical arm 44, to lock the second socket 34 in place.

Each #9 slip on rail fitting 28 in the third embodiment is identical in construction with each one in the first embodiment described above.

Figure 10:
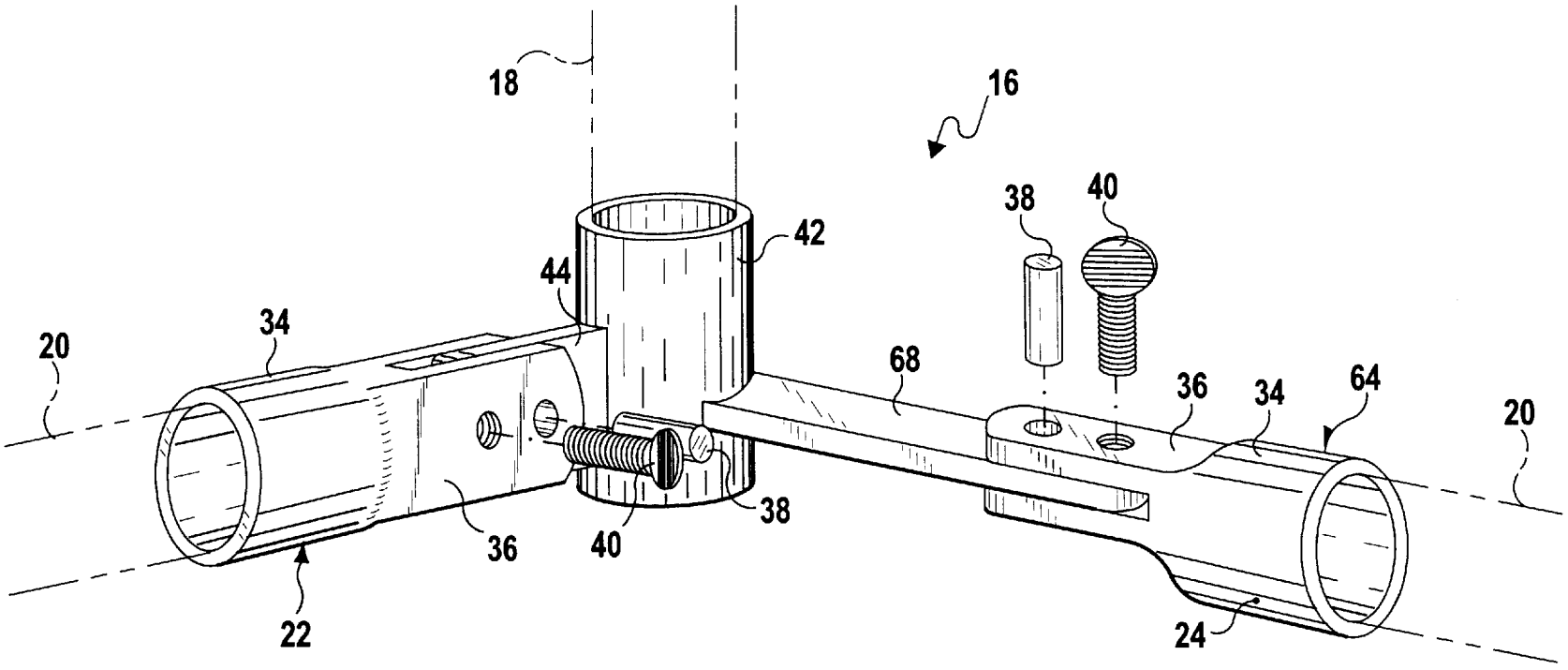

Each #10 slip on rail fitting 64, as best seen in FIG. 10, includes a sleeve 42 to receive one end of the elongated post 18. A vertical arm 44 extends from a left side of the sleeve 42. A horizontal elongated arm 68 extends at a ninety degree angle from a right side of the sleeve 42. A pair of sockets 34 receive opposite ends of the two tubular truss members 20. The sockets 34 each have a forked end 36. The first forked end 36 fits over the vertical arm 44, while the second forked end 36 fits over the horizontal elongated arm 68. A pair of pivot pins 38 are provided. The first pivot pin 38 extends transversely through the first forked end 36 and the vertical arm 44, to allow the first socket to pivot. The second pivot pin 38 extends transversely through the second forked end 36 and the horizontal elongated arm 68, to allow the second socket 34 to pivot. A pair of thumbscrews 40 are also provided. The first thumbscrew 40 threads transversely through the first forked end 36 and the vertical arm 44, to lock the first socket 34 in place. The second thumbscrew 40 threads transversely through the second forked end 36 and the horizontal elongated arm 68, to lock the second socket 34 in place.

Figure 11:
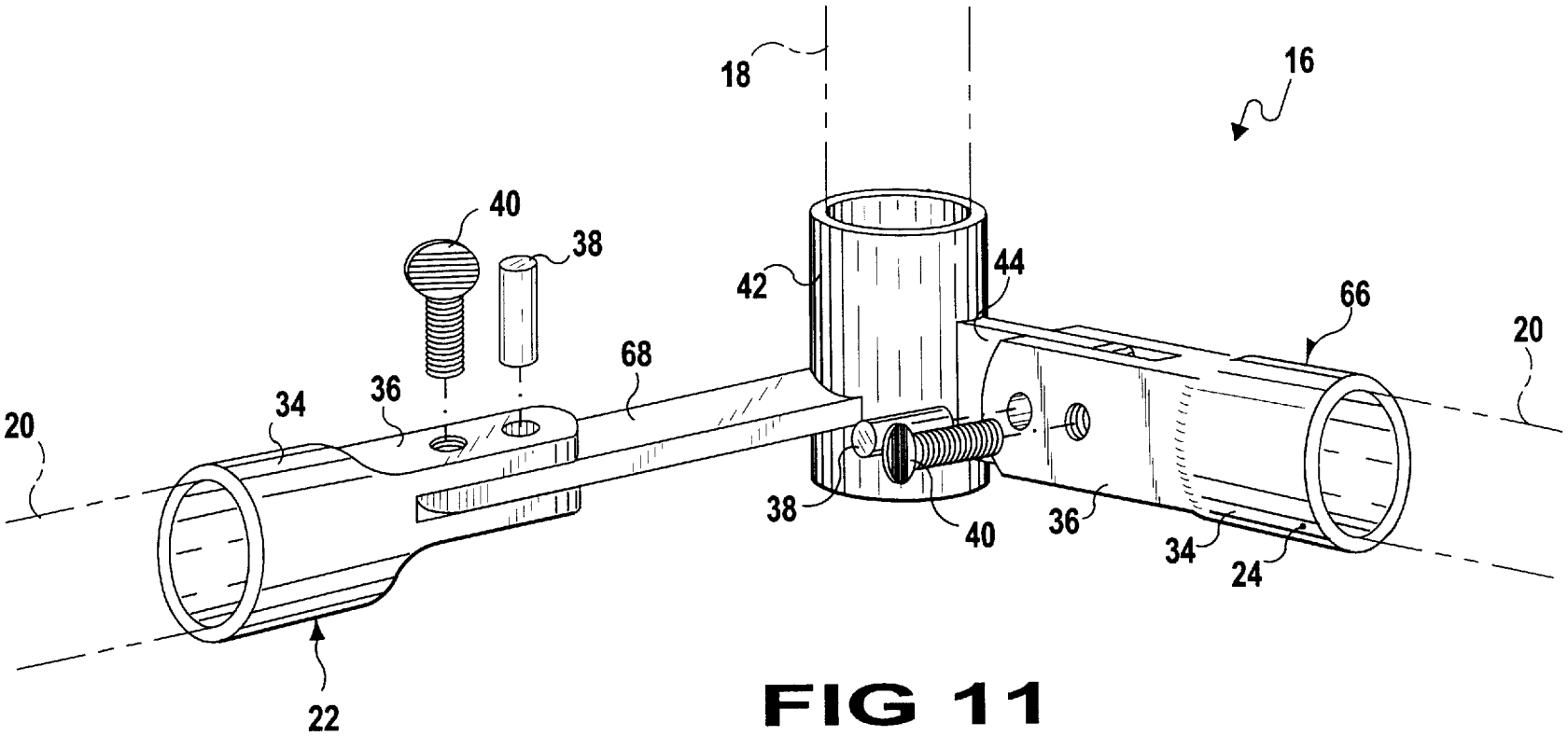

Each #11 slip on rail fitting 66, as best seen in FIG. 11, contains a sleeve 42 to receive one end of the elongated post 18. A horizontal elongated arm 68 extends from a left side of the sleeve 42. A vertical arm 44 extends at a ninety degree angle from a right side of the sleeve 42. A pair of sockets 34 receive opposite ends of the two tubular truss members 20. The sockets 34 each have a forked end 36. The first forked end 36 fits over the horizontal elongated arm 68, while the second forked end 36 fits over the vertical arm 44. A pair of pivot pins 38 are provided. The first pivot pin 38 extends transversely through the first forked end 36 and the horizontal elongated arm 68, to allow the first socket 34 to pivot. The second pivot pin 38 extends transversely through the second forked end 36 and the vertical arm 44, to allow the second socket 34 to pivot. A pair of thumbscrews 40 are also provided. The first thumbscrew 40 threads transversely through the first forked end 36 and the horizontal elongated arm 68, to lock the first socket 34 in place. The second thumbscrew 40 threads transversely through the second forked end 36 and the vertical arm 44, to lock the second socket 34 in place.

The folding structure 16, as shown in FIG. 1, can be used as a Sukkah which is an enclosure that Jews erect for observance of the holiday of Succoth. A plurality of wall panels 70 are attached about the enclosure with ties or nonrusting snap fasteners. Each wall panel 70 is fabricated out of a woven nylon thread fabric 72 and coated with urethane on both sides. A bamboo screen mat 74 is placed upon the top to function as a roof to complete the Sukkah. A folding structure 16 can also be used as a tent, a temporary work enclosure, a scaffolding and a merchandise display unit.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A folding structure comprising:

a) a plurality of vertical elongated posts;

b) a plurality of horizontal tubular truss members;

c) means for keeping said structure unfolded and permitting said structure to be folded comprising a plurality of post connectors to affix together said elongated posts vertically and said tubular truss members horizontally and truss connectors for joining horizontal tubular truss members together to form a fully assembled collapsible enclosure, that can be unfolded into a four sided framework to be utilized when needed and then can be folded up into a compact package to be stored when not in use;

d) each of said post connectors comprising a sleeve to receive a post, a pair of flat horizontal arms extending from said sleeve, a pair of sockets to receive ends of adjacent truss members, each of said sockets having a forked end opposite the end receiving a truss member enveloping one of said horizontal arms, a pivot pin for each of said forked ends extending transversely through the forked end and the enveloped horizontal arm, and a thumbscrew threaded transversely through said forked end into said horizontal arm, said thumbscrew holding said structure unfolded and permitting said truss members upon removal of said thumbscrew to fold about the pivot pins;

e) each of said truss connectors comprising a flat swivel bar, a pair of sockets receiving ends of two tubular members, each of said sockets having a forked end that envelops one end of said swivel bar, a pivot pin for each of the forked ends extending transversely through the forked end and the swivel bar permitting folding of the two tubular members, and a thumbscrew for each forked end threaded transversely through the forked end and the swivel bar to prevent folding of the two tubular members, the removal of all of said thumbscrews permitting said truss members to be folded while use of said thumbscrews maintains said structure in an unfolded condition.

2. A folding structure as recited in claim 1, wherein said elongated posts, said tubular truss members and said connectors are all fabricated out of a lightweight, strong durable material.

* * * * *